United States Patent [19]

Dusel et al.

[11] Patent Number: 4,713,880

[45] Date of Patent: Dec. 22, 1987

[54] LEAD MAKING MACHINE

[75] Inventors: Robert O. Dusel, Brookfield; Harold J. Keene, Waukesha, both of Wis.; James Berres, Houston, Tex.; Gerald Blaha, Waukesha, Wis.

[73] Assignee: Artos Engineering Company, New Berlin, Wis.

[21] Appl. No.: 24,887

[22] Filed: Mar. 11, 1987

Related U.S. Application Data

[63] Continuation of Ser. No. 849,564, Apr. 8, 1986, abandoned.

[51] Int. Cl.[4] ..... H01R 43/04

[52] U.S. Cl. ..... 29/564.4; 81/9.51

[58] Field of Search ..... 29/564.4, 564.6, 564.8, 29/747, 748, 753; 81/9.51

[56] References Cited

U.S. PATENT DOCUMENTS

| | | | |
|---|---|---|---|
| 2,756,619 | 7/1956 | Scharf | 81/9.51 |
| 2,954,599 | 10/1960 | Cootes et al. | 81/9.51 |
| 3,019,679 | 2/1962 | Schwalm et al. | 81/9.51 |
| 3,155,136 | 11/1964 | Laskowski | 29/564.4 X |
| 3,368,428 | 2/1968 | Gudmestad | 81/9.51 |
| 3,612,369 | 10/1971 | Grebe et al. | 226/24 |
| 4,087,908 | 5/1978 | Fusco et al. | 29/753 |
| 4,249,433 | 2/1981 | Hara | 81/9.51 |
| 4,454,652 | 6/1984 | Suzuki et al. | 29/564.4 X |

OTHER PUBLICATIONS

Komax Model 40 Brochure, undated, Komax Corporation, Northbrook, Ill.

*Primary Examiner*—William R. Briggs

*Attorney, Agent, or Firm*—James E. Nilles; Nicholas A. Kees

[57] ABSTRACT

A machine including apparatus for accurately measuring and inserting into the machine almost any desired predetermined length of insulated wire, a device for cutting the wire to that length and stripping the insulation from the ends of the wire, and apparatus for attaching a terminal to one or both of the stripped ends. The measuring apparatus includes a pair of belts each reeved about a pair of pulleys. From the measuring apparatus the wire passes through a flexible tube and through two linearly aligned grippers, separated by the cutting and stripping device. Once the wire is fed to the proper length, the two grippers grip the wire, and the wire is cut and stripped, creating a lead of the predetermined length. As the wire and lead are drawn back, the stripped ends may be inspected by an inspection device so as to ensure that they are properly cut and stripped before electrical terminals are applied. Each of the two grippers then rotates in the same direction, that is, both clockwise or both counterclockwise, to align the respective end of the wire and the lead with a respective terminal attaching machine. There an electrical terminal is attached to each end unless the inspection device has determined the particular stripped end to be not properly stripped. The gripping means then rotate back to align with each other again and the wire and lead are released.

11 Claims, 17 Drawing Figures

LEAD MAKING MACHINE

This application is a continuation of application Ser. No. 849,564, filed Apr. 8, 1986 abandoned.

BACKGROUND OF THE INVENTION

This invention relates to machines for making electrical leads comprising a length of wire having a terminal at one or both ends, and in particular to lead making machines which automatically measure the length of the wires and cut them to length, strip the ends, and attach terminals thereto, all in a continuous and high-speed fashion.

This type of machine has been commonly employed to cut desired lengths of insulated wire from a continuous supply and to remove a small portion of insulation from one or both ends of the wire so that a terminal may be attached to the wire or a soldering operation performed thereon. Machines of this type are particularly useful in rapidly cutting large numbers of wires to uniform desired lengths for use in wiring electric panels or other apparatus. Because of this usage, the speed and accuracy of operation of the wire cutting, stripping and terminating machine are primary considerations.

In the development and construction of such lead making machines, it has been found most advantageous to provide stationary cutting and stripping modules and to move the wire into position to be cut off, stripped and have the terminal attached. To a great extent, then, the speed and precision of the lead making machine depends upon the operation of the wire transport mechanism and the coordination of its operation with the operation of the cutting, stripping and terminating modules.

Examples of this type of machine are shown in Schwalm et al, U.S. Pat. No. 3,019,679, Gudmestad, U.S. Pat. No. 3,368,428 and Hara, U.S. Pat. No. 4,249,433. In each of these patents is disclosed a machine for cutting wire to length and stripping one or both ends. The Schwalm patent goes on to describe as a part thereof the machine for attaching the terminals to the wire ends. The Gudmestad and Hara patents merely refer to the fact that a terminal attachment machine may be used to attach terminals to the cut-and-stripped wires which are the products of the disclosed machines.

This invention relates to improvements over the machines described above and to solutions to some of the problems raised thereby.

SUMMARY OF THE INVENTION

The invention includes means for accurately measuring and drawing into the machine almost any desired predetermined length of insulated wire, means for cutting the wire to that length, means for stripping the insulation from the ends of the wire and means for attaching a terminal to one or both of the stripped ends. The wire is inserted at one end of the machine embodying the invention from an infinite source of insulated wire. The wire passes through a metering means, which measures the amount of wire passing through it. This metering means doubles as an insertion means, inserting the wire into the machine to be processed. The metering means is a pair of belts each reeved about a pair of pulleys. The outer surface of one flight of each belt bears on the facing surface of the opposing belt. Smaller rollers are provided to ensure proper pressure between belts. The wire is threaded between the opposing faces of the two belts. From the metering means the wire passes through a flexible tube means and through two linearly aligned gripping means, separated by the cutting and stripping means. Once the wire is fed to the proper length, the two gripping means grip the wire, and the wire is cut by the cutting means, creating a lead of the predetermined length. At the same time, the stripping means also closes on the wire and lead near the point of the cut, and cuts through the insulation surrounding the wire. The lead and the wire are then drawn out of the stripping means by the gripping means, leaving behind the portions of the insulation cut off by the stripping means. As the wire and lead are drawn back, the stripped ends may be inspected by inspecting means to ensure that they are properly cut and stripped before electrical terminals are applied. Each of the two gripping means then rotates the same direction, that is, both clockwise or both counterclockwise, to align the respective end of the wire and the lead with a respective terminal attaching means. There an electrical terminal is attached to each end unless the inspecting means has determined that the end is not properly stripped, in which case the terminal attachment means is disabled from attaching a terminal. The gripping means then rotate back so as to align with each other again and the wire and lead are released. The lead is collected with other leads similarly manufactured. The wire is fed in further by the metering means until the predetermined length is attained, when the gripping means again grips the wire preparatory to cutting it to begin the cycle again.

It is thus an object of the invention to provide a lead making machine which can accept insulated wire, measure and cut it to a predetermined length, strip the insulation from the ends and attach terminals thereto.

Another object of the invention is to provide a lead making machine as described above wherein the means for measuring the predetermined length of the desired lead includes a pair of belts reeved about a pair of pulleys, the belts having flat outer surfaces which face each other, with the wire being fed between the facing belt surfaces, the pulleys being driven by control means so as to measure the amount of wire fed into the machine by the belts.

Yet another object of the invention is to provide a lead making machine as described above including gripping means for holding the wire and lead ends during the cutting and stripping operations and for moving the ends to the terminal attachment means to have terminals attached thereto.

A more detailed object of the invention is to provide a lead making machine as described above wherein the gripping means pivots on a generally vertical axis in order to move the ends to the terminal attachment means, that vertical axis passing through the approximate center of gravity of the gripping means.

Another detailed object of the invention is to provide a lead making machine as described above wherein the gripping means retracts to pull the insulation to be stripped off the wire. In one embodiment the gripping means then remains retracted until aligned with the terminal attachment means, whereupon the end is inserted into a barrel-type terminal and clamped. In another embodiment, the gripping means returns to its extended position simultaneously with moving into alignment with the terminal attachment means, and lowers the stripped end onto a stake-on terminal where it is clamped.

Yet another detailed object of the invention is to provide a lead making machine as described above having flexible tube means connecting the measuring means to the gripping means, with the wire passing through the flexible tube means, so as to ensure that the wire is properly fed to the gripping means regardless of the movement of the gripping means with respect to the measuring means.

Other objects and advantages of the invention will become apparent hereinafter.

DESCRIPTION OF THE DRAWINGS

FIG. 15 is an exploded view of a stripped wire end with a stake-on terminal being applied thereto, while

FIG. 17 is an exploded view of a stripped wire end with a barrel-type terminal being applied thereto, while

DESCRIPTION OF THE PREFERRED EMBODIMENTS

Figure 1:
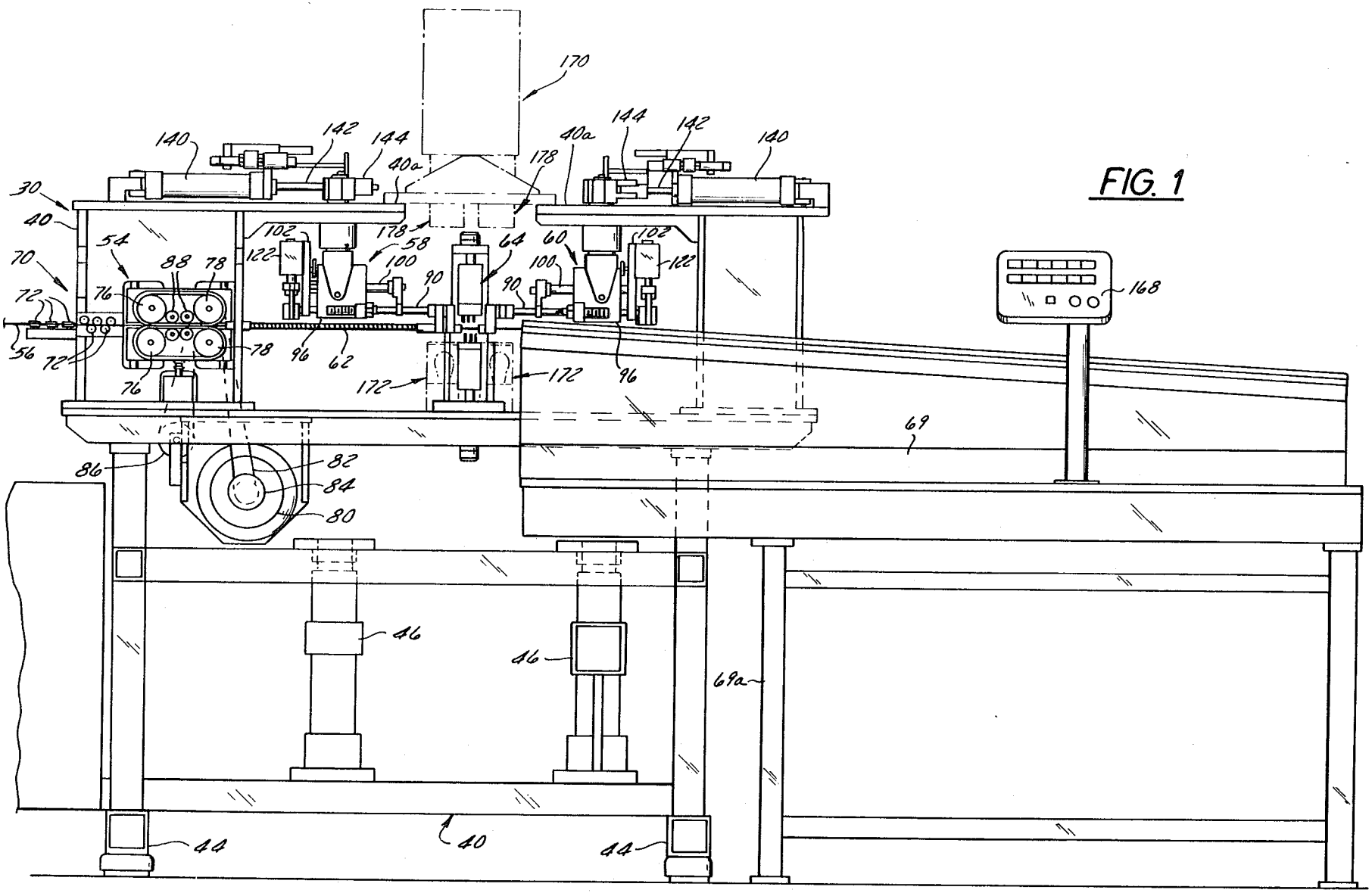
FIG. 1 is a side view of a lead making machine constructed according to one embodiment of the invention, with the terminal attachment presses removed for clarity.
Figure 2:
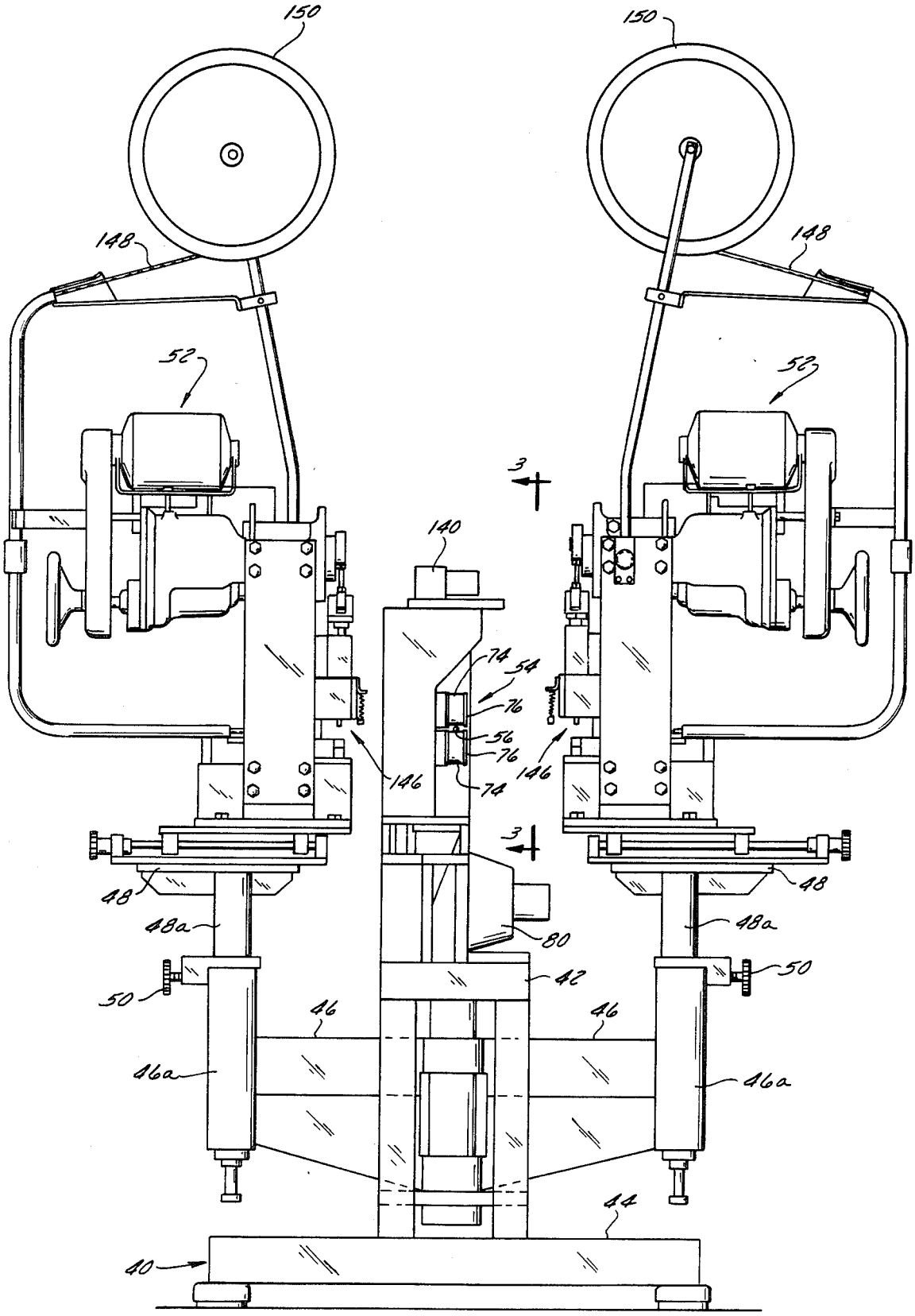
FIG. 2 is an end view of the machine shown in FIG. 1, including the terminal attachment presses.

Referring now to FIG. 1, a machine 30 is constructed according to the invention for making electrical leads with a terminal attached to at least one end thereof. A frame 40 is supplied to provide support to the various components to be described below. Referring also to FIG. 2, frame 40 includes a central, generally horizontally elongated and vertically arranged pedestal 42 resting lengthwise on a pair of elongated transverse bridges 44, one such bridge 44 supporting each end of the pedestal 42. In addition, frame 40 supports a plurality of arms 46, each of which projects laterally outward from the sides of the frame 40. Each of the arms 46 in turn supports a platform 48 at a height which is adjustable by means of a slider portion **48*a* below platform 48 itself, which slider 48*a* is slidably mounted and received in a tube 46*a* at the distal end of each arm 46. The actual height may be fixed by any suitable means such as a set screw 50 which is threaded through the tube 46*a* and contacts slider 48*b* to prevent relative movement between the slider 48*a* and the tube 46*a*. As shown in FIG. 2, a terminal attachment means 52 rests on and is supported by each platform 48. These terminal attachment means 52** will be described in more detail subsequently.

The lead making machine 30, then, rests on and is supported by the frame 40. Generally, referring now mainly to FIG. 1, the lead making machine 30 includes a metering means 54 which receives insulated wire 56 from a wire source (not shown). Metering means 54 feeds a measured amount of wire 56 to a pair of gripping means 58 and 60 which oppose or face each other. Gripping means 58 is a wire gripping means while gripping means 60 is a lead gripping means. The wire 56 is fed by the metering means 54, via flexible tube means 62, to wire gripping means 58, through cutting and stripping means 64, and finally to lead gripping means 60. Flexible tube means 62 may be any suitable elongated tube having sufficient smoothness and a sufficiently low coefficient of friction on its internal surface to allow wire to pass freely therethrough, and long enough to connect the metering means to the wire gripping means 58. In the most preferred embodiment the tube 62 is a metal spring, which allows almost infinite transverse bending and flexing to accommodate the movement of the wire gripping means 58.

Figures 3, 4:
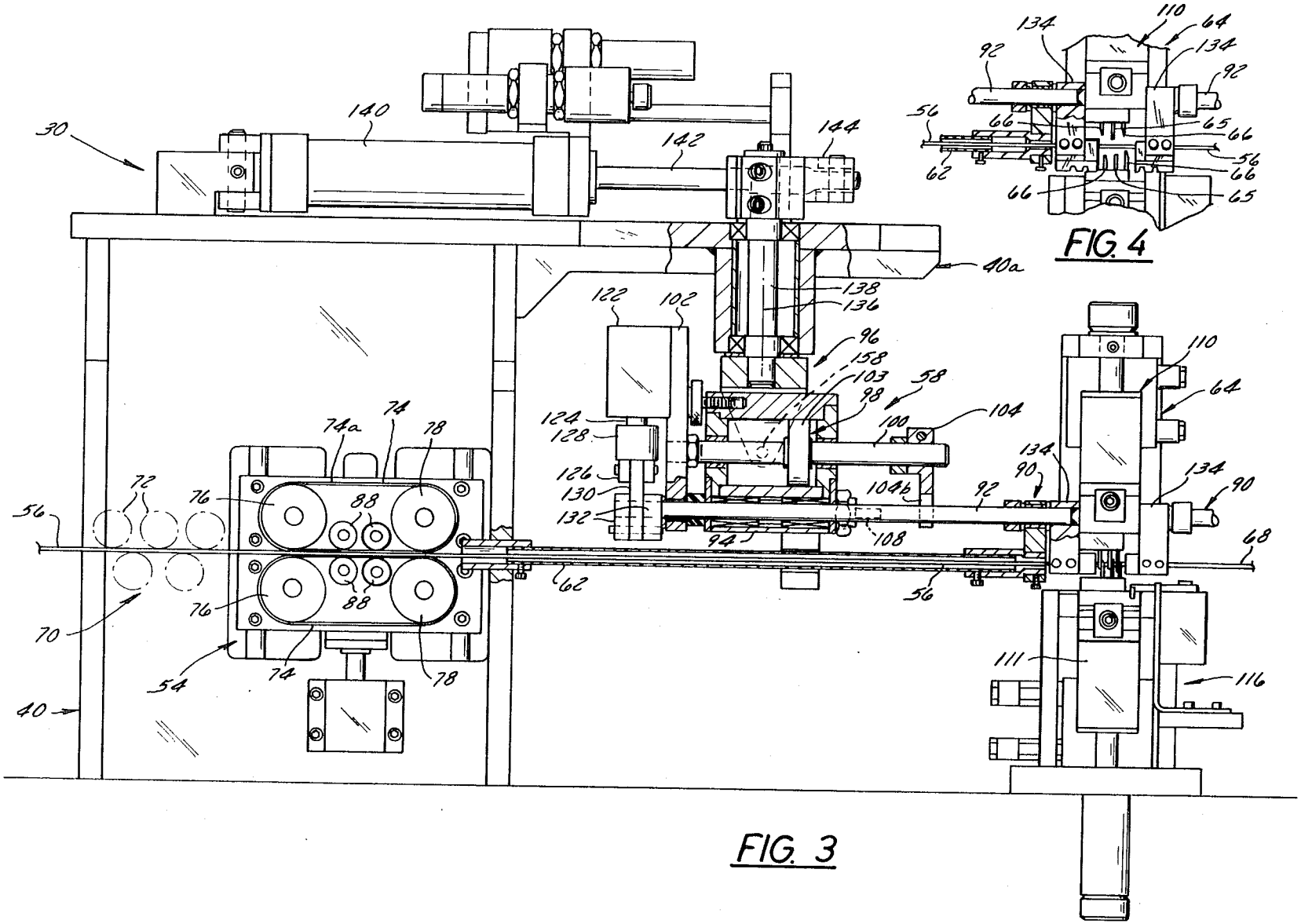
FIG. 3 is an enlarged side view of a portion of the machine shown in FIG. 1, partially in section along line 3—3 of FIG. 2, showing the cutting means and stripping means in the closed position.
FIG. 4 is a fragmentary view of the cutting means and the stripping means of FIG. 3, except shown in the open position.
Figure 5:
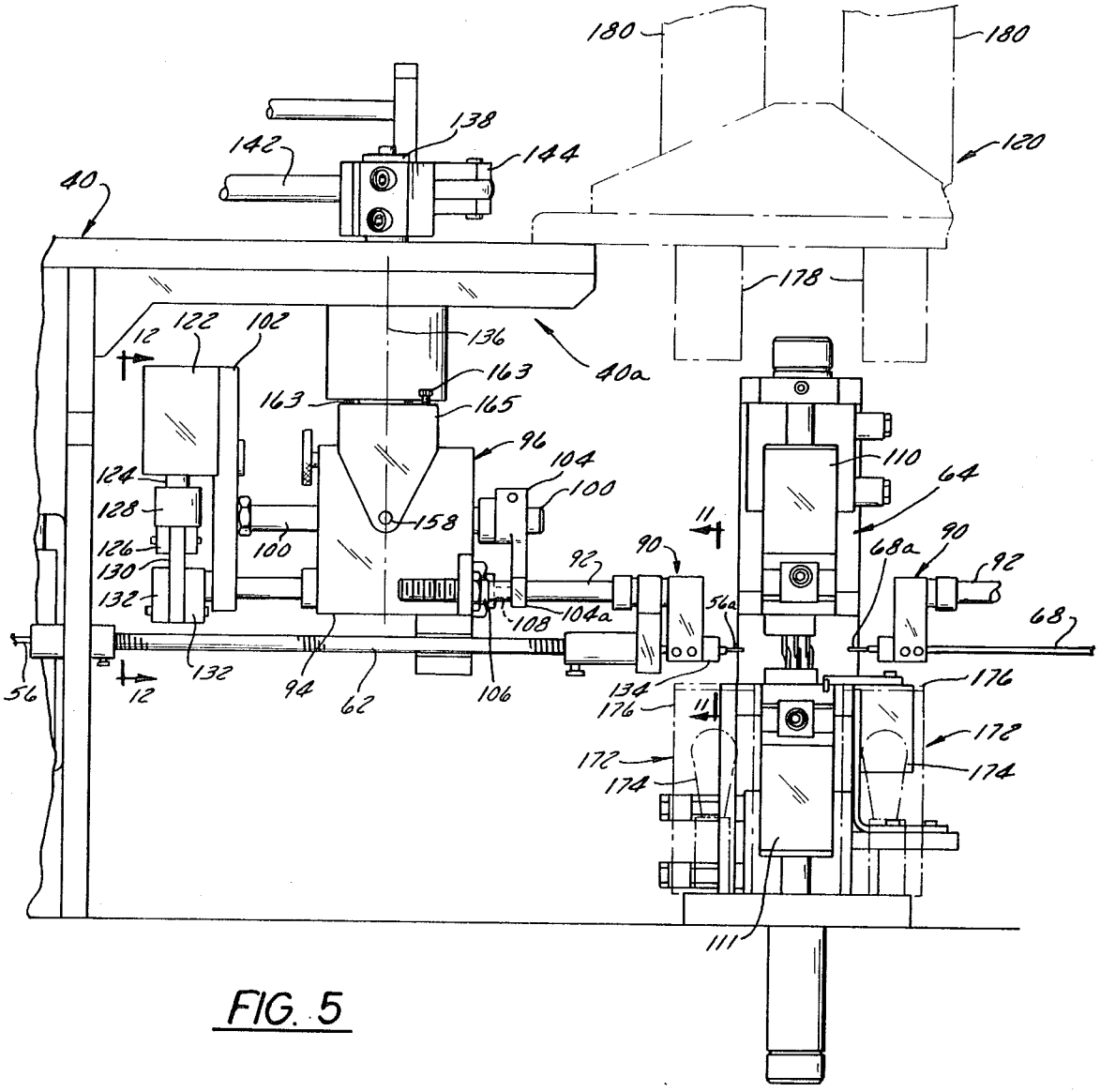
FIG. 5 is a side view of the machine shown in FIG. 3, showing the gripping means in its retracted position after the wire has been cut and stripped.
Figure 6:
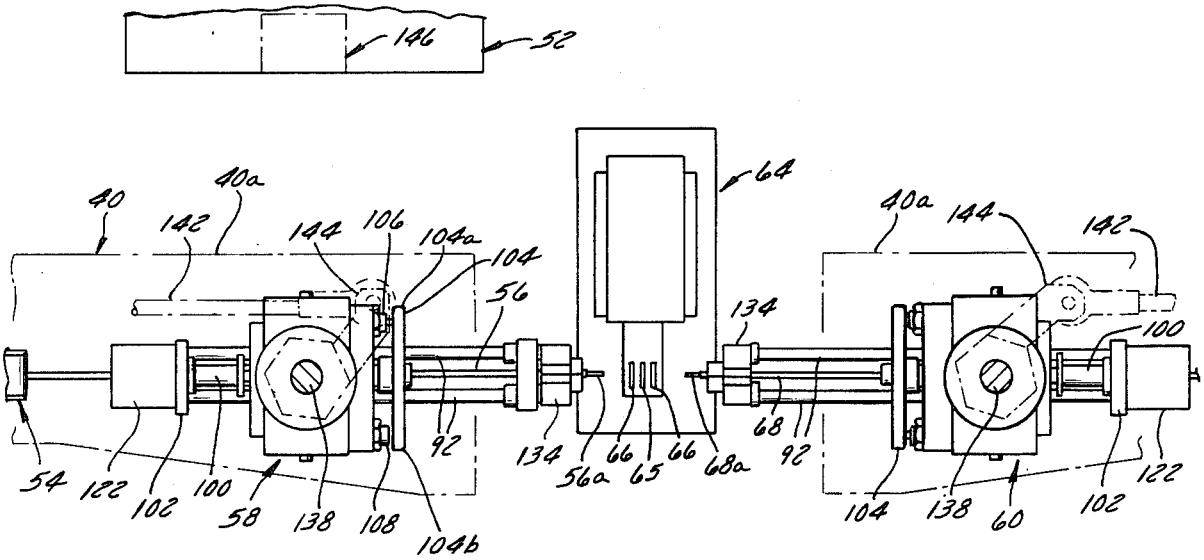
FIG. 6 is a top view of the machine according to this invention showing the gripping means in its retracted and non-rotated position.
Figure 6:
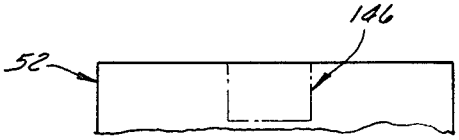
Figure 9:
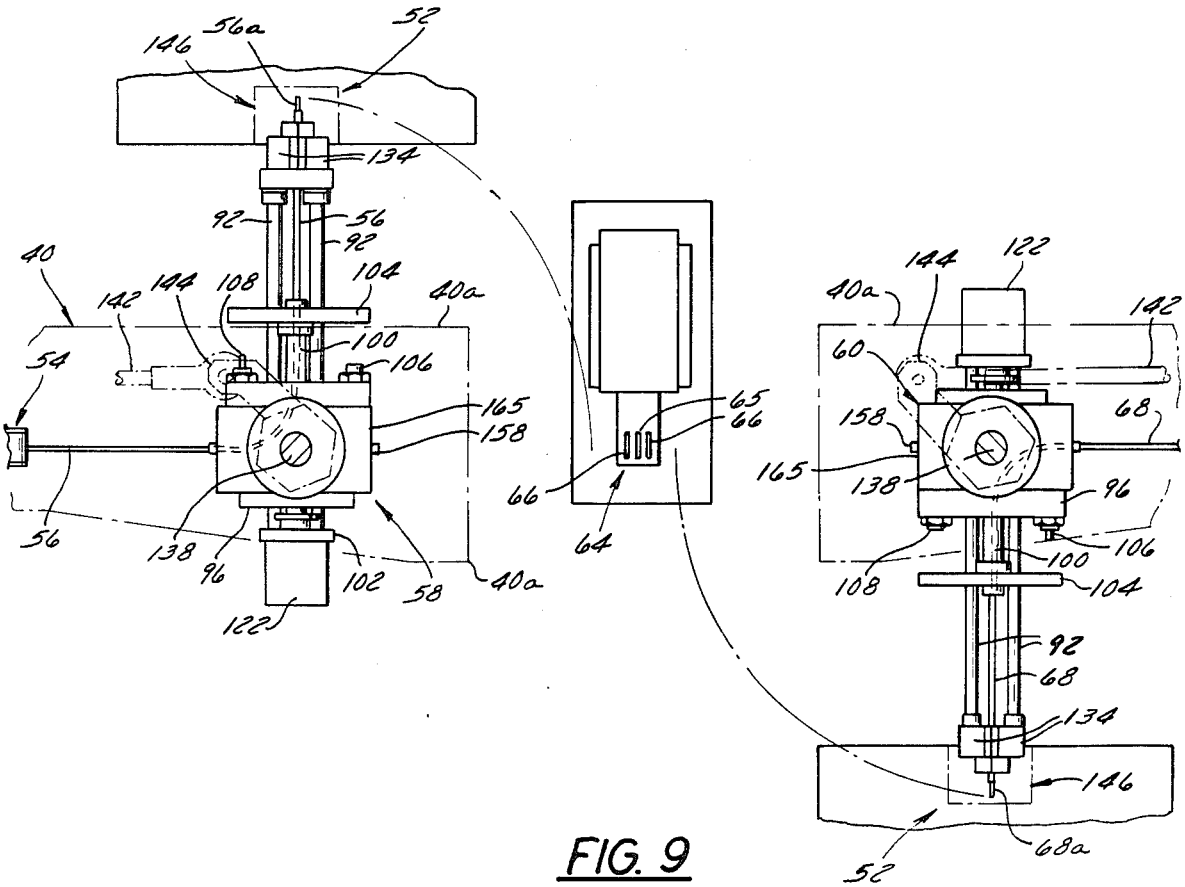
FIG. 9 is a top view, partially schematic, of the machine according to this invention showing the gripping means in its extended and rotated position.
Figure 7:
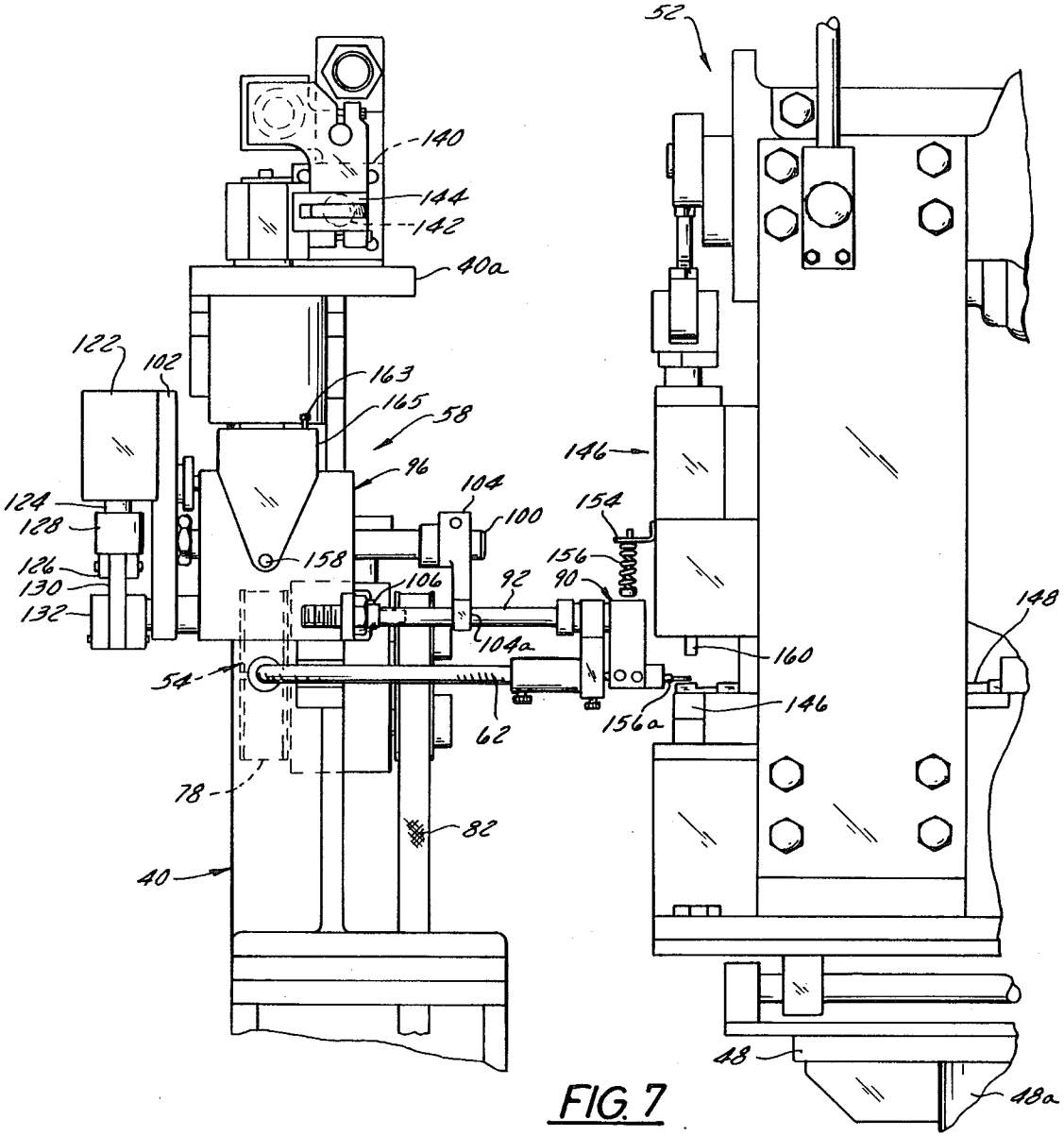
FIG. 7 is an end view of the machine according to this invention showing the gripping means in its rotated position, aligning the wire end with the terminal attachment press preparatory to attachment of a terminal.
Figure 16:
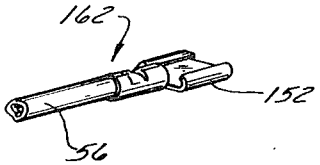
FIG. 16 is an assembled view thereof.
Figure 8:
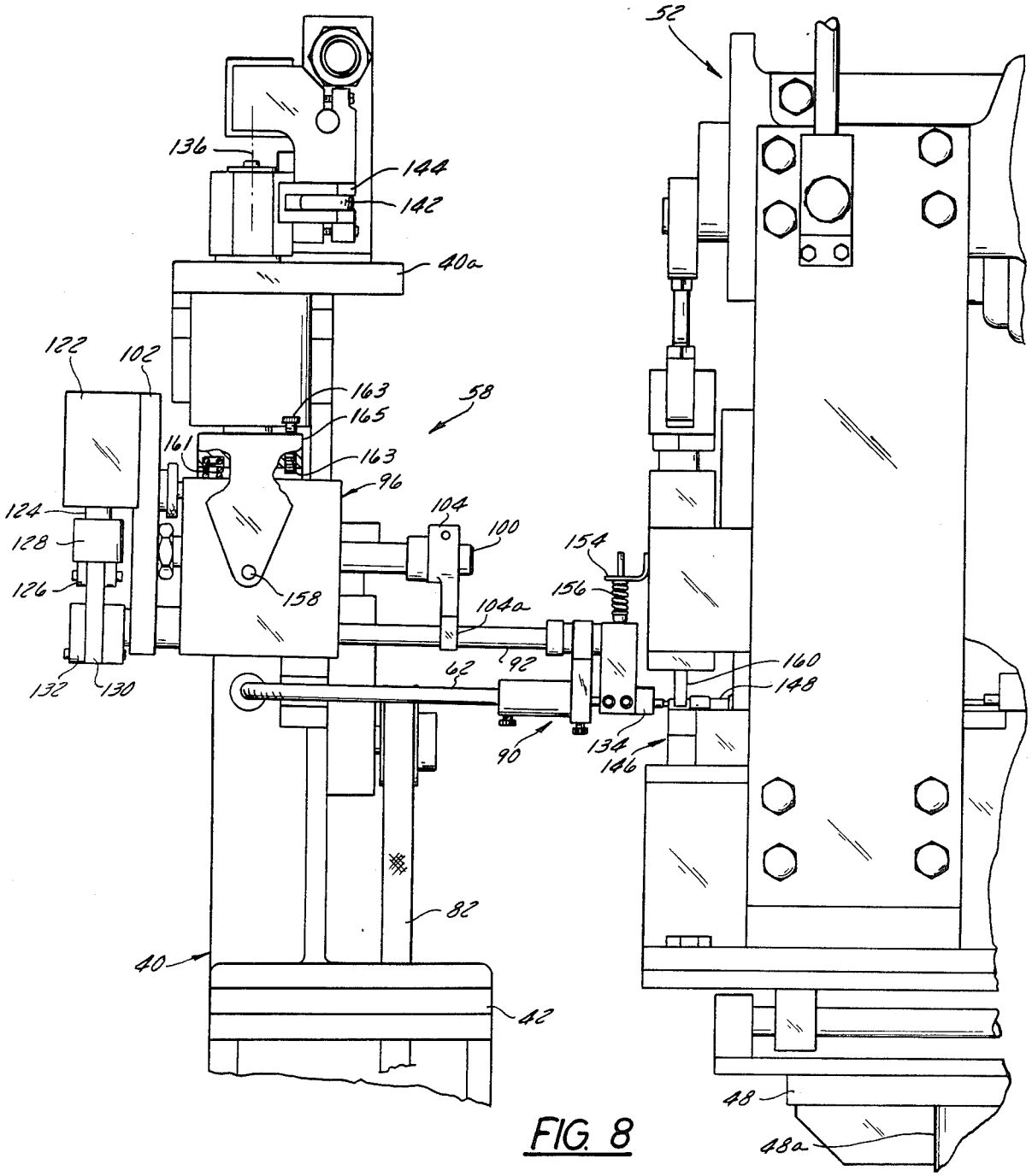
FIG. 8 is a view similar to FIG. 7 except that the terminal attachment means is shown clamping down on the terminal to attach it to a stripped wire end.

Gripping means 58 and 60 then close on and grip the wire 56 a small distance from each other, facing each other, with the cutting means and stripping means positioned therebetween, as shown in FIG. 4. Next, the cutting and stripping means 64 close on the wire 56, cutting it off at the location of the cutting means as shown in FIG. 3. The length of the lead 68 gripped by the lead gripping means 60 is thus established. At the same time, the cutting and stripping means 64 cuts through the insulation surrounding the wire 56 a short distance from each side of the point of thw wire cut, without cutting the metal portion of either the wire 56 or lead 68. The next step is that the gripping means 58 and 60 both retract axially from the cutting and stripping means 64, as shown in FIG. 5 and partially schematically in FIG. 6, effectively removing a short portion of the insulation from the end **56*a* of wire 56 and the end 68*a* of lead 68. At this point, an inspection means 170 may inspect the stripped wire end 56*a* and/or the stripped lead end 68*a* to ensure that the parameters of the ends are within predetermined parameters for properly stripped ends. Next, each gripping means 58 and 60 rotates about its own generally vertical axis in the same direction as the opposite gripping means is rotating, that is, both may rotate counterclockwise as shown in FIGS. 7 and 8, and partially schematically in FIG. 9, or both may equally well rotate clockwise. As shown there, the gripping means 58 and 60 rotate so as to align wire end 56***a* and lead end 68*a* with the terminal attachment means 52 so that a terminal may be attached to one or both ends 56*a* and 68*a*. If the inspection means 170 determines that the stripped end does not fall within the predetermined parameters, the terminal attachment means 52 is prevented from attaching a terminal. Otherwise the attachment operation proceeds to completion. After terminal attachment means 52 have completed the attachment operation, the gripping means 58 and 60 rotate in the reverse direction so as to restore themselves to their original positions. The gripping means 58 and 60 then release the wire 56 and lead 68 respectively. The lead 68 is collected into a bin 69 (FIG. 1), supported by its own support frame 69*a*. The wire 56 is then fed into the gripping means 58 and 60 again, and the cycle begins anew.

Metering Means

As referred to above, the lead making machine 30 includes a metering means 54 which receives insulated wire 56 from a wire source and feeds a measured amount thereof to gripping means 58 and 60. As can be seen in more detail by FIG. 2 and FIG. 3, it should first be noted that metering means 54 includes a wire straightening means 70 for taking out all or at least most of the curl which the wire 56 accumulates in the course of storage, such as on a spool or in a barrel. Wire straightening means 70 includes a plurality of rollers 72 (FIGS. 1 and 3) which are journaled to the frame 40. These rollers 72 force the wire 56 to traverse a path which is straight in at least one plane for a short distance so as to remove any curl in that plane. Two sets of rollers 72 are provided, one in each plane, so that most of the curl of the wire 56 is removed in both planes before the wire is passed into the machine to be processed. The metering means 54 also includes a pair of endless belts 74, each reeved about a first pulley 76 and a second pulley 78 so that belts 74 are arranged coplanarly with each other. Each belt 74 has a flat continuous outer surface 74*a*, which outer surfaces face each other for a distance of one flight of each belt 74. In each belt-and-pulley arrangement the second pulley 78 is the drive pulley, connected to a prime mover such as an electric motor 80 (FIG. 1) by any suitable drive transmission means, such as a belt 82 reeved about a drive pulley 84 at motor 80 and an idler pulley 86 journaled to frame 40, so as to allow the proper stopping and starting of the belts 74, inserting the proper amount of wire 56 into the machine as needed. The first pulley 76 is generally the metering pulley, to which instruments (not shown) are attached to monitor the number of revolutions thereof, and thereby measure the amount of wire 56 passing between the belts 74. In an alternative embodiment, the motor 80 is a servo motor, with the instruments attached thereto for measuring the amount of wire 56 inserted into the machine, in which case the first pulley 76 is merely an idler pulley. In either case, smaller idler rollers 88 are provided between first pulley 76 and second pulley 78. These rollers are also journaled to the frame 40, and bear on the flight of each belt 74 which faces the opposite belt, so as to ensure proper pressure between the two belts 74 to prevent slippage of the wire 56 with respect to the belts. The wire 56 is threaded into the nip between the belts 74 and securely held there, without damage to the wire or insulation. Since the belts contact the wire for a distance, that is, the distance between the pulleys 76 and 78, the belts 74 also contribute to the wire straightening function of the wire straightening means 70. Further, to ensure more exact metering of the wire 56 and to prevent slippage between the belts 74 and the pulleys 76 and 78 and rollers 82, the belts may be toothed belts, with the pulleys and rollers also being toothed so as to mesh with the belts.

Cutting and Stripping Means, and Gripping Means

As referred to above, wire 56 is fed by the metering means 4, via flexible tube means 62, to wire gripping means 58, through cutting and stripping means 64, and finally to the lead gripping means 60. The wire gripping means 58 is shown in more detail in FIGS. 3 and 5 through 16, while FIG. 4 shows the cutting and stripping means 64 in more detail. The lead gripping means 60 is identical to the wire gripping means 58 except that the orientation is rotated 180 degrees about a vertical axis. Hence the wire gripping means 58 will be described in detail, with the description thereof being understood to also describe the lead gripping means 60.

Figure 11:
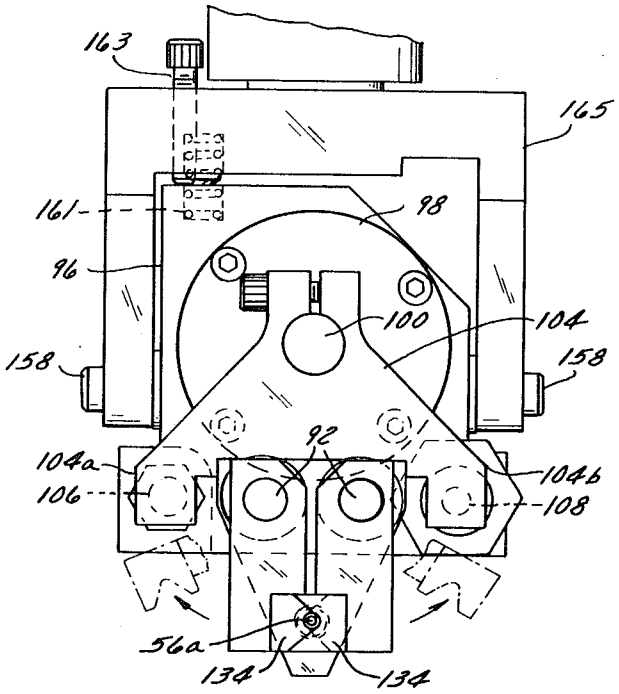
FIG. 11 is an end view of the gripping means, along line 11—11 of FIG. 5, shown in the closed position, with the open position shown in phantom.
Figure 10:
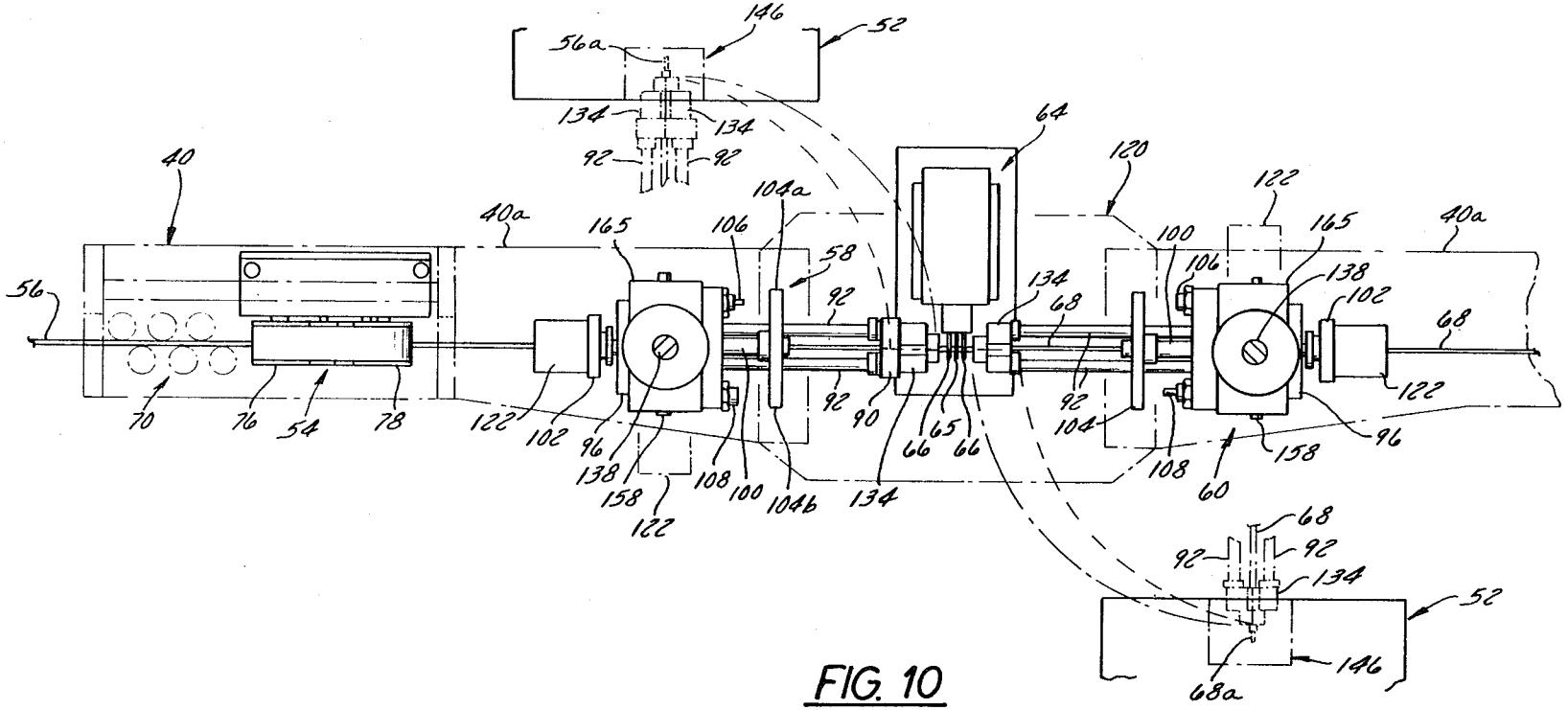
FIG. 10 is a top view, partially schematic, of the machine according to this invention showing the gripping means in its extended and non-rotated position, with the extended and rotated position shown in phantom.
Figure 12:
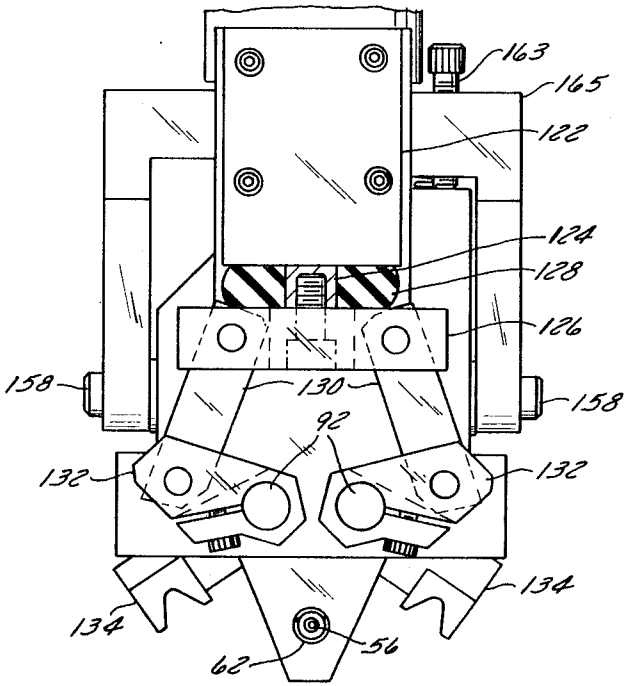
FIG. 12 is a sectional view of the gripping means of FIG. 5, shown in the open position, and taken along line 12—12.
Figure 13:
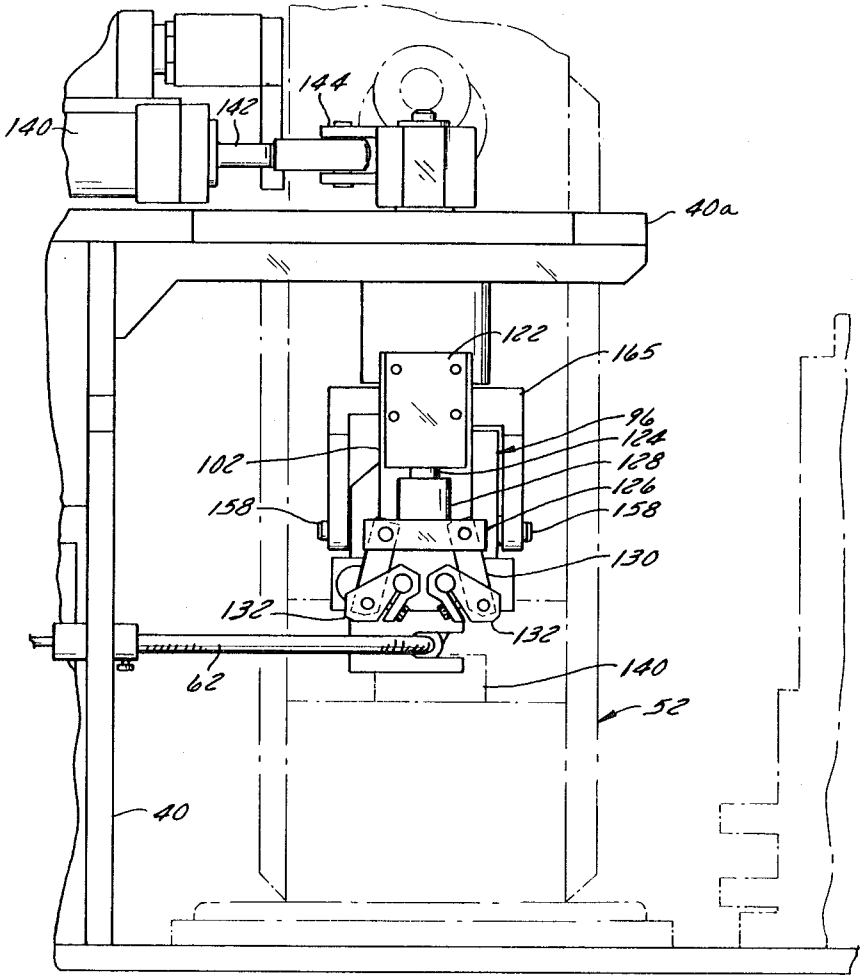
FIG. 13 is a side view of the machine according to the invention, showing the gripping means in its rotated position, aligning the wire end with the terminal attachment press for attachment of a terminal.
Figure 14:
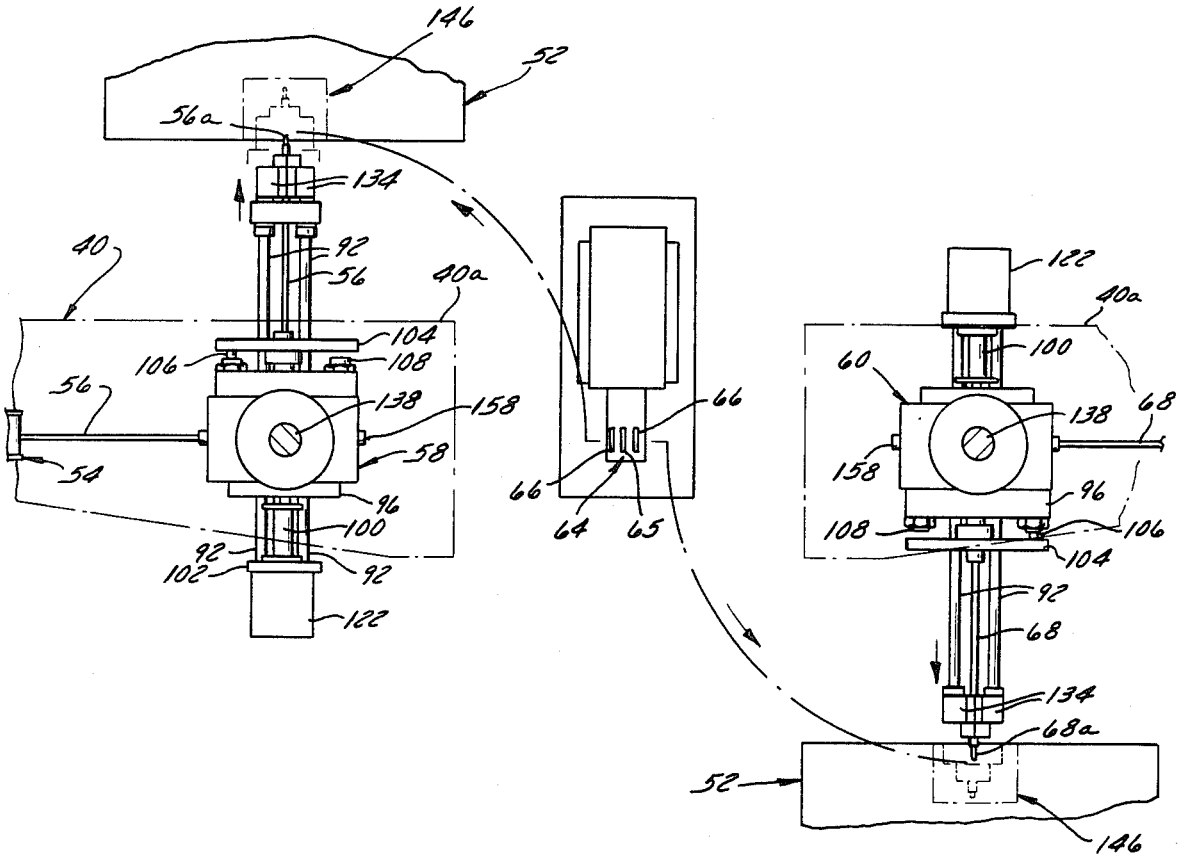
FIG. 14 is a top view, partially schematic, of the machine according to this invention showing the gripping means in its retracted and rotated position, with the extended and rotated position shown in phantom.

Referring particularly now to those figures, beginning with FIGS. 3 and 10, the wire gripping means 58 includes a wire-holding head 90 attached at the distal end of a pair of horizontally oriented slider rods 92. Slider rods 92 are axially slidably mounted in a sheath portion 94 of a gripping means body 96. Body 96 is journaled to and supported overhead by a portion 40*a* of the frame 40. The action of the body 96 will be explained in more detail by reference to the terminal attachment means 52 below. Slider rods 92 operate the wire-holding head 90 as follows with particular reference to FIGS. 11 and 12. FIG. 11 is an end view of the wire-holding head 90 from the right end as shown in FIG. 5. FIG. 12 is an end view of the body 96 from the left end as shown in FIG. 5. Also, the same view of the body 96 as shown in FIG. 12, except with the wire-holding head 90 closed, is shown in FIG. 13. As there shown, a power cylinder 122 is attached to bracket 102, with its piston 124 arranged to extend vertically downward therefrom. To the end of the piston 124 is attached a crossbar 126. An elastomeric bumper means 128 may be placed on piston 124 between crossbar 126 and cylinder 122 as a shock absorbing means. To each end of crossbar 126 is pivotably connected one of two links 130, which in turn each have a lever arm 132 connected rotatably thereto. Each such lever arm 132 is non-rotatably affixed to one respective slider rod 92. A C-shaped clamp means 134 is non-rotatably attached to the opposite end of each slider rod 92. Hence when cylinder 122 causes piston 124 and in turn crossbar 126 to move downward, links 130 thereby cause lever arms 132 to rotate. In turn, each slider rod 92 is rotated about its longitudinal axis, which causes the two C-shaped clamp means 134 to close. Thus the wire 56 located therebetween is held in place. Conversely, when cylinder 122 causes piston 124 and in turn crossbar 126 to move upward, links 130 and lever arms 132 rotate each slider rod 92 about its longitudinal axis in the opposite direction, which causes the two C-shaped clamp means 134 to open and release the wire.

Slider rods 92 are shown in FIG. 3 in their extended position, the position they are in when the wire 56 is fed into the gripping means 58. Slider rods 92 are slid backward (to the left in FIGS. 3 and 10) into a retracted position shown in FIG. 6 by a power cylinder 98, which cylinder 98 is oriented parallel to the slider rods 92. The rod 100 of cylinder 98 is attached to the slider rods 92, at the end opposite the wire-holding head 90, by any suitable means such as bracket 102. Although the cylinder 98 shown in the drawing figures is an air cylinder with a piston 103, the movement of rod 100 may be caused by any suitable means such as a solenoid or hydraulics. As shown in FIGS. 3 and 10, the rod 100 of cylinder 98 projects forward (to the right) beyond the cylinder 98 itself. An inverted-U shaped bracket 104 is attached adjustably to the distal end of the rod 100. As can be seen by comparing FIG. 10, showing the wire gripping means 58 in its extended position, with FIG. 6, showing wire gripping means 58 in its retracted position, the purpose of bracket 104 is to contact a sensor means 106 with one leg **104*a* thereof so as to discontinue the retraction motion. The opposite leg 104*b* contacts a shock absorbing means 108 so as to reduce routine impact loading of the assembly. The purpose of this retraction of the gripping means 58 is to accomplish the stripping of the wire 56 by use of the cutting and stripping means 64** after the wire is cut.

The preferred embodiment of the cutting and stripping means 64 can be seen in more detail by comparing FIG. 3 and FIG. 4. As shown there, the cutting and stripping means 64 include a pair of generally vertically oriented power cylinders 110 and 111, with cylinder 110 located above the wire 56 and cylinder 111 below. The cutting and stripping means 64 also includes a pair of cutting knives 65, facing each other and arranged to pass by each other closely so as to shear anything between them in guillotine fashion. The upper cutting knife 65 is attached to the upper power cylinder 110, while the lower cutting knife 65 is affixed to the power cylinder 111. Both cylinders 110 and 111 are attached to and supported by a standard 116 which in turn is attached to and supported by the frame 40. Similarly, the preferred embodiment of the cutting and stripping means 64 includes a one pair of stripping knives 66 located on each side of cutting knives 65, and arranged parallel to and spaced apart from the cutting knives 65. While cutting knives 65 are attached to cylinders 110 and 111 so as to pass by each other and cut off the wire set between them, stripping knives 66 are on the other hand attached to cylinders 110 and 111 respectively so as to partially but not completely pass by each other, thereby cutting through the insulation surrounding the wire and holding the insulation without cutting or in any way damaging the wire 56. Hence in one motion the cylinders 110 and 111 force cutting knives 65 and stripping knives 66 together, thereby cutting through the wire 56 at one point and cutting through the insulation at a point on each side of the wire cut, without causing any interference with the passage of the wire 56 during loading or measuring. As described above, the gripping means 58 and 60 then move from their extended position to their retracted position, pulling the wire 56 and lead 68 out of the insulation held by the cutting and stripping means 64, to the position shown in FIG. 5 and in top view in FIG. 6. The remaining insulation may then be removed by any suitable means.

Terminal Attachment Means

As referred to above, wire gripping means 58 is rotatable about a generally vertical axis 136, the location of which coincides with a generally vertically oriented shaft 138. Shaft 138 is joined to body 96 at the lower end of the shaft 138 and projects upward through frame portion **40*a*, journaled thereto and ending slightly thereabove. The axis of rotation passes approximately through the center of gravity of the wire gripping means 58. The purpose of this centering of the axis of rotation is to reduce the swinging mass of the wire gripping means 58 during rotation, so as to allow an increase in speed and throughput over previously known machines. The rotation of the wire gripping means 58 is accomplished as follows referring to FIG. 3. The upper frame portion 40*a* supports and has attached thereto a power cylinder 140 with a rod 142 extending to the right in that figure. The opposite end of that rod 142 is rotatably connected to a pivot arm 144 which in turn is non-rotatably affixed to the shaft 138 so that, when the rod 142 is extended, the body 96 is positioned so as to align the wire-holding head 90 with the cutting means 66 and stripping means 64. When the rod 142 is drawn into the cylinder 140, the body is rotated so as to align the wire-holding head 90 with the terminal attachment means 52, as shown in FIG. 7 and in top view in FIG. 9. Notice also in FIG. 9** that the gripping means has returned to its extended position during the course of the rotation.

Figure 15:
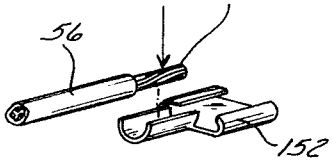

Each terminal attachment means 52 includes a generally conventional terminal attachment press 146 (FIG. 2) which is fed terminals attached together in a chain-like manner 148 from a reel or other source 150. The operation of terminal attachment means 52 and the cooperation thereof with the gripping means 58 in one mode of operation can be seen by comparing FIG. 7 to FIG. 8. As shown in those figures, wire gripping means 58 has already been simultaneously rotated and extended so as to align the wire end **56*a* over a typical stake-on type terminal 152. FIG. 15 shows the relative orientation of the wire end 56*a* to the stake-on terminal 152. Referring again to FIGS. 7 and 8, a tab 154 is attached to the press 146, and protrudes laterally outward therefrom. Suspended vertically downward from the tab 154 is a spring 156. Tab 154 and spring 156 are located so as to be just above wire-holding head 90 when wire gripping means 58 has rotated to align stripped wire end 56*a* with the terminal attachment means 52. Then, when press 146 is lowered, spring 156 presses down on wire-holding head 90, causing gripping means body 96 to rotate slightly about a horizontally pivotable mounting axis 158, enough that the wire end 56*a* is lowered onto the terminal 152 before the die portion 160 of press 146 contacts the terminal. Biasing means 161 and stop means 163 (FIG. 8) may be provided between the body 96 and the bracket 165 on which it pivots to bias the body 96 so as to return the wire-holding head 90 to the raised position after the press 146 is raised. The terminal 152 is thus clamped onto the stripped wire end 56*a*, resulting in the terminated wire end 162 shown in FIG. 16**.

Figure 17:
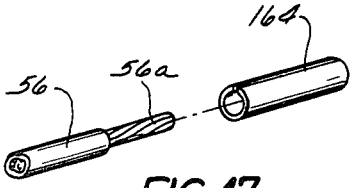
Figure 18:
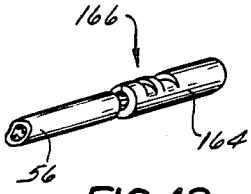
FIG. 18 is an assembled view thereof.

It was noted above that the wire gripping means 58 is extended during the course of the rotation when a stake-on type terminal 152 is to be attached to the stripped wire end **56*a*. If on the other hand a barrel type terminal 164 (FIG. 17) is to be attached to the stripped wire end 56*a*, the wire gripping means 58 is not extended while it is being rotated. Rather, as shown in top view in FIG. 14, it is held in the retracted position until it is fully rotated. After the rotation is complete, the wire gripping means 58 is extended, sliding the stripped wire end 56***a* into the terminal 164 as shown in FIG. 17. As mentioned earlier, the height of the terminal attachment means 52 may be adjusted by use of tubes 46*a*, sliders 48*a* and set screws 50. The press is then lowered and the terminal clamped to the wire end to produce the terminated wire end 166 shown in FIG. 18. The decision as to whether to extend the wire gripping means 58 concurrently with its rotation or to extend only after completion of the rotation is made by a human operator (not shown) and the order is given by use of a control means 168 (FIG. 1) supported by the frame 40 and electrically or otherwise connected to the various parts of the machine 30. Further, the wire gripping means 58 and the lead gripping means 60 may be controlled independently. There is thus no reason why a barrel-type terminal 164 could not be attached to one end of a lead and a stake-on type terminal 152 attached to the opposite end.

Another advantageous feature of this invention is that it will readily receive an inspecting means 170 (FIG. 5) for inspecting the stripped wire end 56*a* and stripped lead end 68*a* for ensuring that the stripped ends meet certain predetermined parameters, and for preventing the terminal attachment means from attaching a terminal to the particular wire end if the end is outside those parameters. One such inspection means is disclosed in a U.S. patent application, Ser. No. 831,533, filed on Feb. 21, 1986. The disclosure of that application is incorporated herein by reference. Referring now to FIG. 5, in the preferred embodiment of this invention, the inspection means 170 includes two illuminated fields 172, one located beneath the stripped wire end 56*a* and one located beneath the stripped lead end 68*a*, when both gripping means 58 and 60 are in their retracted and non-rotated positions. Each illuminated field 172 includes a light source 174, and a translucent surface 176 located between the light source 174 and the respective wire end 56*a* or 68*a*. The gripping means 58 and 60 pause for a short period (preferably on the order of 50 milliseconds) in this retracted and non-rotated position. An optical lens 178 is located opposite the illuminated field 172 so that the respective stripped end 56*a* or 68*a* is located between the lens and the field during the pause. A control means (not shown) is located inside a control enclose 18, which enclosure is supported. by frame portion 40*a*. This control means accepts an optical image from the lens 178 during the pause, subsequently determines whether the parameters of the respective end fall within the predetermined parameters for a properly stripped end, and controls the terminal attachment means accordingly. If the end is proper, a terminal is attached thereto as if the inspection means 170 did not exist. If the end is not properly stripped, the terminal attachment means is disabled from attaching a terminal thereto. By this means leads having improperly stripped ends may be easily discovered and removed from the collection bin 69 before they are used in an electrical circuit where they could malfunction. This is true because improperly stripped leads are much more readily distinguished by not having terminals attached, rather than attaching the terminals to defectively stripped leads and later testing them to ensure quality. This has the effect of reducing overall waste.

While the apparatus hereinbefore described is effectively adapted to fulfill the aforesaid objects, it is to be understood that the invention is not intended to be limited to the particular preferred embodiments of lead making machine herein set forth. Rather, it is to be taken as including all reasonable equivalents without departing from the scope of the appended claims.

We claim:

1. A lead making machine for accepting insulated wire from a wire source and producing electrical leads, comprising:

a metering means for pushing wire into said machine and measuring the length of wire as it is pushed in;

movble gripping means for gripping said wire and said lead and placing them at certain positions for processing; and flexible tube means for receiving wire from said metering means and directing it to said gripping means regardless of the movement of said gripping means;

a frame-like support member for supporting the various parts;

cutting means located on said support member for cutting the wire once a predetermined length of wire has been pushed into the machine by said metering means, thus creating a lead of predetermined length;

stripping means carried with said cutting means for cutting through insulation on said wire and said lead at adjacent ends thereof approximately simultaneously with the cutting of the wire by said cutting means, and holding the insulation after the cutting;

means for reciprocatingly moving said gripping means axially from an extended position to a retracted position, thereby pulling said wire and said lead out of said stripping means after said insulation is cut, and thereby removing said insulation from the end of said wire and from the end of said lead and creating a stripped wire end and a stripped lead end;

terminal attachment means mounted on said support member for attaching electrical terminals to at least one of said stripped lead end and said stripped wire end;

means for rotating said gripping means about a vertical axis which extends through the approximate center of gravity of said gripping means, to position said stripped wire end and said stripped lead end at said terminal attachment means for attachment of an electric terminal to a least one of said stripped wire end and said stripped lead end; and electronic visual inspection means for visually inspecting at least one of said stripped wire end and said stripped lead end to determine whether said end is properly stripped within certain predetermined parameters, and for disabling said terminal attachment means from attaching a terminal to an end which does not satisfy those parameters.

2. A lead making machine as recited in claim 1 further comprising pause control means for causing said gripping means to pause just after said stripping means has stripped said wire end and said lead end to allow said inspection means to inspect said ends.

3. A lead making machine as recited in claim 1 or claim 2 further comprising rotation control means for causing said gripping means, after pulling said wire and lead out of said stripping means, to remain in its retracted position until aligned with said terminal attachment means, and thereafter causing said gripping means to move to its extended position to insert the particular stripped end into a barrel-type terminal.

4. A lead making machine as recited in claim 1 or claim 2 further comprising rotation control means for causing said gripping means, after pulling said wire and lead out of said stripping means, to move to its extended position simultaneously with moving to align with said terminal attachment means.

5. A lead making machine as recited in claim 2 wherein said electronic visual inspection means includes:

two illuminated fields attached to said frame, one located beneath the retracted position of each of said gripping means;

an optical lens located over each of said illuminated fields so that said respective stripped ends are between said field and said lens when said pause control means pauses said gripping means.

6. A lead making machine as recited in claim 5 wherein each of said illuminated fields includes a light source, and a translucent surface positioned between said light source and said respective stripped end for evenly diffusing the light from said light source.

7. A lead making machine as recited in claim 2 or claim 6 wherein each of said gripping means includes:

a gripper body, a pair of slider rods slidably mounted through said gripper body;

a pair of clamp members each non-rotatably connected at one end to one end of each of said slider rods, the opposite end of each of said lever arms having means for cooperating with the clamp member of the other of said lever arms to grip said respective wire ends when moved together and release said wire ends when moved apart;

slider rod rotating means connected to the opposite ends of said slider rods for rotating each slider rod about its longitudinal axis thereby moving said cooperating alternately together and apart.

8. A lead making machine as recited in claim 7 wherein said slider rod rotating means includes:

a pair of lever arms each non-rotatably connected to a respective one of said slider rods at the ends of said slider rods opposite where said clamp members are attached;

a pair of links each rotatably attached at one end to a respective one of said lever arms;

a crossbar attached at each end to a respective one of said links; and a power cylinder having a piston attached to said crossbar for moving said crossbar so as to alternately rotate said lever arms and thus said slider rods.

9. A lead making machine as recited in claim 7 wherein said means for reciprocally moving said gripping means axially between an extended position and a retracted position includes means for sliding said slider rods axially within said gripper body.

10. A lead making machine as recited in claim 7 wherein said means for rotating each of said gripping means about said vertical axis includes:

a shaft affixed to said body and journaled with respect to said support member, said shaft projecting through said support member opposite said body;

a pivot arm non-rotatably connected to the end of said shaft projecting through said support member;

a power cylinder attached to said support member and having a piston attached to said pivot arm for moving said pivot arm, thereby rotating said shaft and said body about its vertical axis.

11. A lead making machine as recited in claim 1 wherein said metering means includes a pair of belts each reeved about a pair of pulleys, said belts having flat outer surfaces which face and oppose each other, with the wire being fed between said facing belt surfaces and held there by pressure between said belt surfaces, said pulleys being driven by control means so as to measure the amount of wire fed into said machine by said belts by means of counting the revolutions of said pulleys.

* * * * *